United States Patent [19]

Rich

[11] Patent Number: 4,614,028

[45] Date of Patent: Sep. 30, 1986

[54] ELECTRICAL ASSEMBLY AND METHOD FOR ARRANGING A PLURALITY OF ELECTRICAL CONDUCTORS IN A PATTERN

[75] Inventor: Donald S. Rich, Long Valley, N.J.

[73] Assignee: Thomas & Betts Corporation, Raritan, N.J.

[21] Appl. No.: 555,849

[22] Filed: Nov. 28, 1983

Related U.S. Application Data

[62] Division of Ser. No. 359,143, Mar. 17, 1982, abandoned.

[51] Int. Cl.[4] ..... H01R 43/04

[52] U.S. Cl. ..... 29/749; 29/750; 29/755; 29/857; 339/99 R

[58] Field of Search ..... 29/749, 750, 751, 752, 29/755, 857, 861–867; 339/99 R, 107, 96, 61 R, 61 M, 97 R, 98; 174/135; 140/147; 30/271

[56] References Cited

U.S. PATENT DOCUMENTS

| | | | |
|---|---|---|---|
| 3,936,933 | 2/1976 | Folk et al. | 140/147 |
| 4,076,365 | 2/1978 | Ross et al. | 339/107 |
| 4,125,137 | 11/1978 | Shatto, Jr. | 29/749 |

*Primary Examiner*—Howard N. Goldberg
*Assistant Examiner*—P. W. Echols
*Attorney, Agent, or Firm*—Robert M. Rodrick; Salvatore J. Abbruzzese

[57] ABSTRACT

Flat multiconductor cable is prepared for pitch change mass termination by use of a connector housing having conductor retention channels arranged in the pattern of such pitch change and an assembly tool which collectively forces the conductors of the cable from their mutually aligned disposition in the cable into retention in the channels and hence into the pitch change pattern. The housing includes a further channel accessible exteriorly of the housing and in communication with the retained conductors whereby they may be collectively engaged by insulation piercing contacts.

10 Claims, 12 Drawing Figures

ELECTRICAL ASSEMBLY AND METHOD FOR ARRANGING A PLURALITY OF ELECTRICAL CONDUCTORS IN A PATTERN

The present application is a divisional applicaton of Ser. No. 359,143, now abandoned, and claim is made to the benefit of the filing date of such parent application pursuant to 37 U.S.C. 120.

FIELD OF THE INVENTION

This invention relates generally to methods and apparatus for retentively arranging electrical conductors in desired patterns for the making of electric connections thereto and pertains more particularly to pitch change electrical connectors.

BACKGROUND OF THE INVENTION

In typical flat multiconductor cable interconnect schemes, termination of the cable is often required at a pitch different from that of the cable. Thus, the cable may have a pitch of 0.050 inch (fifty mils between adjacent conductors) while the pitch of pins of a terminating connector may be 0.0545 inch (fifty-four and one half mils).

One approach for such termination involves the connection of each cable conductor to a corresponding pin in a separate practice, a technique referred to as discrete wire termination. Here, each individual conductor of the flat cable is pulled apart from mutually adjacent conductors, insulation is stripped therefrom and the bared conductor is soldered, wire wrapped or otherwise individually connected to the corresponding one of the pins of the termination device.

Another known approach to pitch change termination involves the use of a transition interconnect member, adjunctive to the cable and termination device and being a permanent link in the connection, e.g., a flexible printed circuit (PC) whose conductive traces extend from a first pitch arrangement through a fanned out transition to a second pitch arrangement.

In a third approach, the art has seen the necessary pitch change transition occur in the cable as manufactured. Thus, special multipitch cable has been provided, whereby the terminating device may be joined to the cable at the pitch portions thereof corresponding to the pitch of the terminating device. This general type of approach, i.e., the change of cable pitch, is further embodied in Huber U.S. Pat. No. 4,269,466 wherein cable conductors are rolled into channels of a housing defining pitch change with cover members then applied to opposed sides of the housing to apply strain relief to the loosely channelled conductors.

A fourth approach in the prior art is that of providing a connector having contacts of spread pitch type. This is seen, for example, in Narozny U.S. Pat. No. 3,990,767 wherein a family of identical contacts is selectively bent in assembly of the connector to yield the desired pitch transition. It is seen also in Key U.S. Pat. No. 3,731,254, wherein a family of contacts is stamped prior to assembly with an offset providing the desired pitch transition. In a labor intensive practice, Nickerson et al. U.S. Pat. No. 3,777,299 introduces an adaptor having channels therethrough defining the required pitch change from contact pin to cable. The tail of each pin is selectively bent to conform to the channel configuration whereby it registers with a cable conductor on exiting the channel.

Other than in the case of the discrete wiring approach, the other discussed approaches can provide the convenience of mass termination, i.e., wherein all conductors can be terminated simultaneously. Thus, any practice which collectively places in registry the conductors of first pitch and contacts of second pitch provides the necessary preparation for mass termination. The flexible printed circuit transition, the multipitch cable or Huber end spread cable, the Norozny bendable contacts and the Key stamped offset contacts thus may be called mass termination capable devices. In each of these devices, however, specialized cable adjunct means are needed, e.g., bendable or offset contacts or flexible PC, the cable need be specially fabricated or the cable need be strain relieved by means separate from the pitch changing housing. The labor non-intensive convenience of mass-termination is thus made available generally at substantial cost beyond that of standard contacts and a customary single pitch cable.

SUMMARY OF THE INVENTION

The present invention has as an objective the provision of a labor non-intensive and cost effective approach to preparing a flat multiconductor cable for mass-termination.

Another object of the invention is to provide an expeditious method for retentively arranging a plurality of conductors in a given pattern.

A more particular object of the invention is to provide methods and apparatus for pitch change mass termination of flat multiconductor cable without need for specialized multi-pitch cable, adjunct devices forming a permanent link in the termination, specialized contacts of bendable or stamped variety or adjunct strain relief devices.

In attaining the foregoing and other objects, the invention provides a practice in which a plurality of conductors in one pattern, e.g., aligned in preselected pitch, are collectively displaced into a different pattern, e.g., non-aligned and in different pitch, by application of a common force collectively thereto. Upon application of such force, the conductors extend from such preselected pitch through a transition pitch into such different pitch and are preferably thereby strain-relieved and retentively positioned in preparation for mass-termination, e.g., by insulation displacement or insulation piercing techniques.

Apparatus for use in preparing flat multiconductor cable for mass termination in accordance with the invention includes, preferably as part of the permanent connection, a housing defining the requisite pitch transition through conductor retention channels. In its preferred embodiment, such apparatus includes as a housing a single piece article of manufacture adapted by reason of its own structure to effect pitch change and attendant strain relief. An installation tool or a cover for the housing is adapted to apply the aforesaid common force thereto.

The foregoing and other objects and features of the invention will be further evident from the following detailed description of the particularly preferred practices and embodiments thereof and from the drawings wherein like reference numerals identify like parts throughout.

DESCRIPTION OF THE DRAWINGS

FIG. 9(*a*) is a plan view of a particularly preferred alternative embodiment of a housing and cover arrangement, partly assembled and with the cable omitted for convenience.

FIG. 9(*b*) is a right side elevation of FIG. 9(*a*).

DESCRIPTION OF PREFERRED PRACTICES AND EMBODIMENTS

Figure 3:
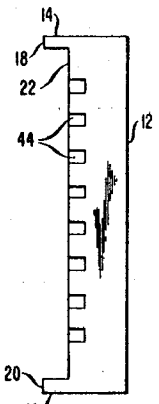
FIG. 3 is a right side elevation of FIG. 1.
Figure 1:
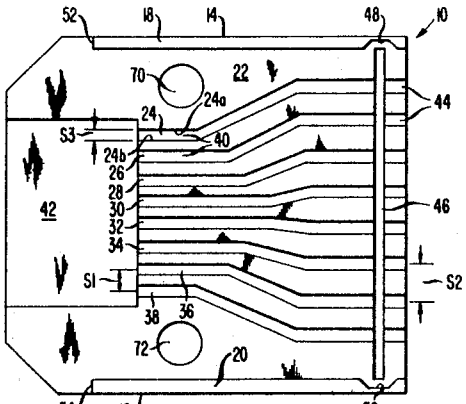
FIG. 1 is a plan view of a connector housing for use in practicing the invention.
Figure 2:
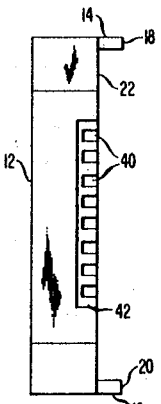
FIG. 2 is a left side elevation of FIG. 1.

Referring to FIGS. 1-3, housing 10, typically a rigid body of electrically insulative material, has outer surface 12, sidewalls 14 and 16 defining surfaces 18 and 20 and recessed surface 22 in which are formed conductor residence channels 24 through 38. The channels have origin openings 40 communicating with compartment 42 leftwardly in FIG. 1 and exit openings 44 at the rightward FIG. 1 housing side. A transverse channel 46 extends into communication with each of channels 24 through 38 and has depth in housing 10 exceeding the depth of such conductor directing channels. Sidewalls 14 and 16 have notches 48 and 50 and terminate short of the housing 10 left side in uprights 52 and 54 whereby housing 10 is adapted for receipt of cover 56 of FIG. 4. The cover has projections 58 and 60 for seating in notches 48 and 50 and side margin steps 62 and 64 cooperative with uprights 52 and 54. Cover 56 further includes openings 66 and 68 which register with openings 70 and 72 of housing 10 to provide for mounting, as discussed below in connection with FIG. 10. Transverse cover opening 74 likewise registers with housing channel 46 for electrical interconnect purposes, also discussed below.

In an illustrative example of practice under the invention, let it be assumed that it is desired to arrange a plurality of conductors in a particular given pattern which would render compatible the mass termination of flat multiconductor cable at fifty mils pitch (0.050 inch) with an insulation piercing contact set at one hundred mils pitch. This example would thus marry a commercial undercarpet telephone cable with a commercially-available terminator.

Stepwise, in accordance with the invention, one will now define a residence path for each conductor corresponding to the desired pitch change. Channels 24–38 are arranged to define such residence paths and include leftward end portions extending mutually parallel at interchannel spacing indicated as S1, rightward end portions extending mutually parallel at interchannel spacing indicated as S2 and acutely angled intermediate portions connecting such end portions.

Where it is desired to retentively maintain the conductors in the given pattern, the residence paths are partly bounded with a capture surface adapted to retentively engage a conductor contiguous therewith, e.g., to provide a frictional, interference type fit therewith. In the embodiment of FIGS. 1-3, such capture surfaces are the channel sidewalls, shown as **24*a* and 24*b* for channel 24. These sidewalls have transverse spacing S3, chosen as somewhat less than the transverse, cross-sectional expanse of the conductor to be resident therein. Such capture surfaces define an opening for insertion of the conductor. Thus each of channels 24–38 opens into surface 22**.

Figure 6:
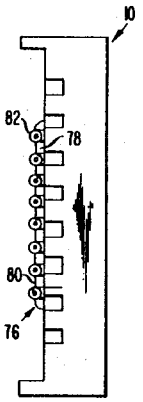
FIG. 6 is a right side elevation of FIG. 5.
Figure 5:
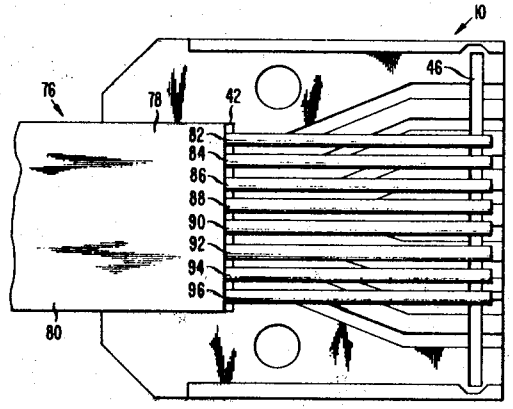
FIG. 5 is a plan view of the FIG. 1 housing preassembled with a flat multiconductor cable, the cable jacketing nesting in the leftward portion of the housing.

Turning to FIGS. 5 and 6, flat multiconductor cable 76 typically has a conductive body 78 and protective jacketing 80 and in the illustrated embodiment eight conductors 82 through 96. Each conductor has insulation extruded thereon and body 78 is extruded collectively on the insulated conductors. Body 78 may be electrically conductive polyvinylchloride (PVC) and jacketing 80 may be an electrically insulative material such as a polyester, for example, MYLAR, commercially available from E. I. duPont. Cable 76 is prepared as indicated, i.e., with conductors 82–96 being of sufficient length outwardly of body 78 to extend beyond transverse channel 46 of housing 10. Body 78 with jacketing 80 is nested in compartment 42. Conductors 82–96 each register with a distinct one of channel origin openings 40 (FIG. 1) and exteriorly overlie (FIG. 6) channels 24–38, extending longitudinally therewith parallel to the above discussed parallel end portions of the channels. Such preassembly of cable 76 and housing 10 is worked further in a manner now discussed with reference to FIG. 7.

Figure 8:
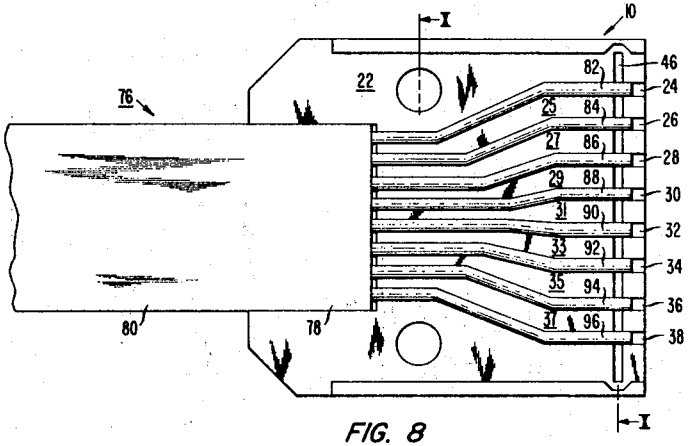
FIG. 8 is a plan view of the assembled cable and housing as provided by the FIG. 7 tool.
Figure 9B:
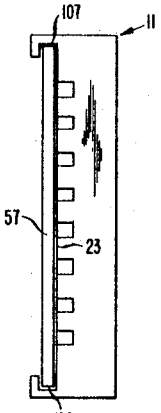
Figure 9A:
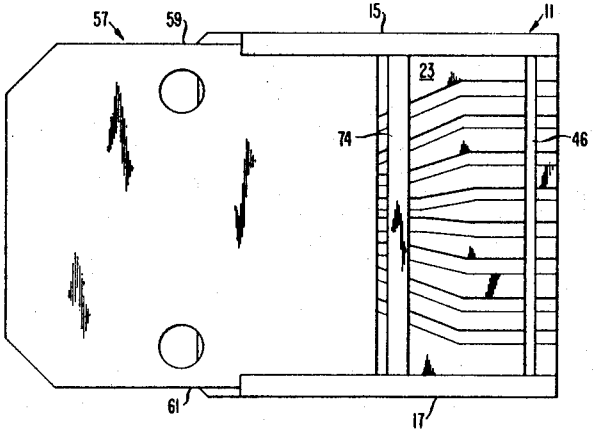

Assembly tool 98 includes base 100 having a floor 102 for supporting housing 10 in abutting relation to stop 104 and with sidewalls 14 and 16 disposed below tracks 106 and 108 of tool sidewalls 110 and 112. Assembly ram 114 has side tongues 116 and 118 adapted to be received in tracks 106 and 108, whereby ram 114 may be slidably driven strokewise into base 100. Depending downwardly below tongues 116 and 118 is platen 120, having a depth D1 preferably equal to or slightly greater than the height H1 of housing sidewalls 14 and 16 above surface 22, such that a light interference fit exists between the platen 120 and the transverse housing surfaces 22 and 25–39 (FIG. 8). It should be appreciated that the platen depth D1 may also be slightly less than the housing sidewall height H1 and at least less than the conductor cross-sectional dimension. Platen 120 has transverse extent between tongues 116 and 118 somewhat less than the transverse spacing of sidewalls 14 and 16.

Figure 9:
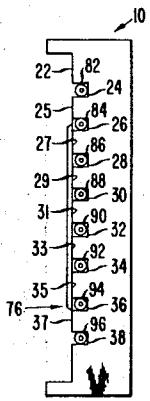
FIG. 9 is a right side elevation of FIG. 8.

The preassembly of cable 76 and housing 10 (FIG. 5) is inserted into tool 98 upon base 100 into abutment with stop 104. Ram 114 is next inserted into base 100 through registry of tongues 116 and 118 in the rear portion of tracks 106 and 108. The ram is now driven fully into base 100 in the course of which motion, leading surface 122 of platen 120 confronts the cable conductors, progressively longitudinally forcing each elongate conductor into the corresponding one of residence channels 24–38 (FIG. 1). For purposes of observation of this result, one may move ram 114 slowly into base 100 and note that the portions of the conductors in registry with the channel origins are rendered channel resident and the forward runs of the conductors are spread transversely as the ram continues into its stroke. Since surface 122 and transverse housing surfaces 25–39 are preferably in a light interference fit or at least spaced apart vertically by a distance substantially less than the cross-sectional extent of the conductors, the force applied to the conductors progressively lengthwise of the residence paths defined by channels 24–38 yields no option for the conductors other than residence in the channels. With ram 114 removed now from either end of base 100, the final assembly of cable 76 and housing 10 is removed and shown in FIGS. 8 and 9. As is shown in FIG. 8, conductors 82–96 commonly overlie transverse channel 46 and conform in pattern to that defined by housing 10. As is shown in FIG. 9, each conductor is seated deeply in its residence channel. The degree of strain relief lengthwise of cable 76 and of retentive capture of conductors 82–96 individually corresponds to the selection of channel dimension S3 (FIG. 1) in relation to the cross-sectional dimension of the conductors. Thus, while some measure of strain relief is afforded by angled channel portions, i.e., channel portions in acute angle relation to the channel parallel end portions, heightened longitudinal strain relief and retentive capture of individual conductors against movement transversely outwardly of the housing is achieved as dimension S3 is provided to be less than the conductor cross-sectional dimension. Ram stroke input force would be increased accordingly. In practice, the lessened dimension S3 permits such retentive capture that the assembly of FIGS. 8 and 9 is maintained to the extent that one may handle same simply by holding cable 76 at its expanse outward of housing 10. Housing 10 is thus a single piece article of manufacture adapted in and of its own structure for combined strain relief and pitch change retention of multiconductor cable. As noted strain relief is effected longitudinally and transversely of the housing. Cover 56 (FIG. 4) contributes cable retention force only by engaging body 78 and not the individual cable conductors.

A particularly preferred embodiment of apparatus is shown in FIGS. 9(*a*) and 9(*b*), wherein upstanding elongate housing 11 is in partial assembly with cover 57. Housing 11 corresponds generally in configuration with housing 10 of FIG. 1 but has its sidewalls 15 and 17 structured to define tracks 107 and 109, running longitudinally therethrough upwardly of transverse surface 23 and conductor retention channels formed therein. Cover 57 corresponds generally in configuration with cover 56 of FIG. 4, but has its margins 59 and 61 rectilinear throughout their length and spaced apart transversely such that they can register in housing tracks 107 and 109. In use, the cable is placed in housing 11 as above discussed for cable placement in housing 10, i.e., with cable body 78 in compartment 42 and with conductors in path origins and overlying surface 23. Now, instead of the use of the FIG. 7 assembly tool, cover 57 is entered atop the cable body into the left side (FIG. 9(*a*)) of tracks 107 and 109 into light interference fit with surface 23 and pushed fully into residence in the tracks, functioning as in the case of platen 120 (FIG. 7) to apply force collectively to and thereby seat the cable conductors fully in the channels of housing 11. The cover is restrained now from upward movement by such seating thereof in tracks 107 and 109 and the unit is readied for assembly with a terminating contact set as in FIG. 10.

Figure 10:
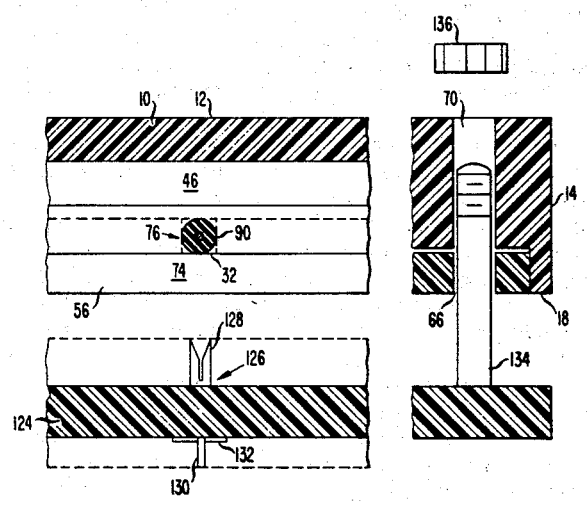
FIG. 10 is a partial sectional view of the assembly of FIG. 8 as seen from broken plane X—X thereof together with the cover of FIG. 4 and a printed circuit (PC) board mount therefor supporting insulation piercing contacts for mass termination of cable conductors.

Referring now to FIG. 10, a typical usage of the prepared cable and housing in providing electrical interconnection is shown. PC board 124 includes a plurality of aligned contact members, one being shown at 126 and having an insulation-piercing contact 128 and a terminal pin 130 extending through board 124 and electrically connected to conductive trace 132. Rightwardly, board 124 has an end portion on which is secured mounting post 134.

Figure 4:
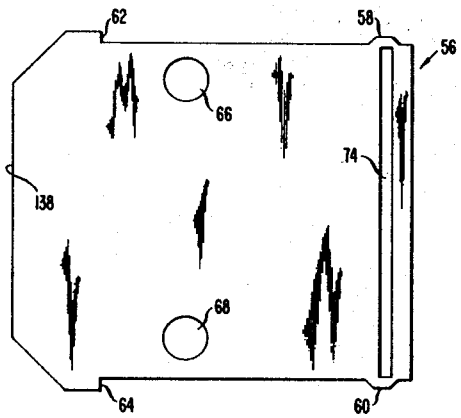
FIG. 4 is a plan view of a cover for the FIG. 1 housing.

Upwardly of board 124, in readiness for mounting thereon is the inverted assembly of housing 10 and cable 76 of FIGS. 8 and 9 further assembled with cover 56 of FIG. 4, one insulated conductor being shown as 90 in channel 32. Post 134 is in registry with cover opening 66 and housing opening 70 and is positioned relative to contact member 126 such that the contact members will register with cover opening 74 and housing transverse channel 46. Thus, on downward movement of the assembled housing 10, cover 56 and cable 76, all contact members will pass through cover transverse opening 74 and into and beyond the cable, upper ends of contacts 128 entering channel 46. The assembly is effected, for example, by tightening of nut 136 on post 134 and counterpart tightening of the nut and post (not shown) associated with housing opening 72 and cover opening 68 (FIGS. 1 and 4). During such assembly, the insulation piecing contact portions 128 of each contact 126 penetrate the outer insulation and engage the conductive portion of the respective conductors 82–96. While assembly has been shown herein by use of nut 136 tightened on post 134, it should be understood that other assembly techniques, such as crimping with suitable tooling, may also be used.

In the depicted embodiment of the invention, the cable conductors are prepared for insertion into the channels of housing 10 by removing body 78 therefrom. Thus, the conductors are not webbed to one another, or otherwise mutually fixedly positioned, as they are spread into the desired configuration.

The invention is otherwise applicable to apply pattern arrangement to webbed conductor cable. Thus, commercial ribbon multiconductor cable of one type is fabricated by extruding electrical insulation directly upon bare conductors spaced mutually at desired pitch in the extruder. The opposed exterior surfaces of the cable typically are undulated, diminishing in the thickness to thin webs between adjacent conductors. Such cable can be placed in the described housing embodiment in which event the webbing is broken in the course of ram stroking in the assembly tool. To enhance the separation of webbed conductors, transverse housing surfaces 25–39 may be configured to define an upward cusp or the like providing a more expeditious web cutting action during the ram stroke.

Figure 7:
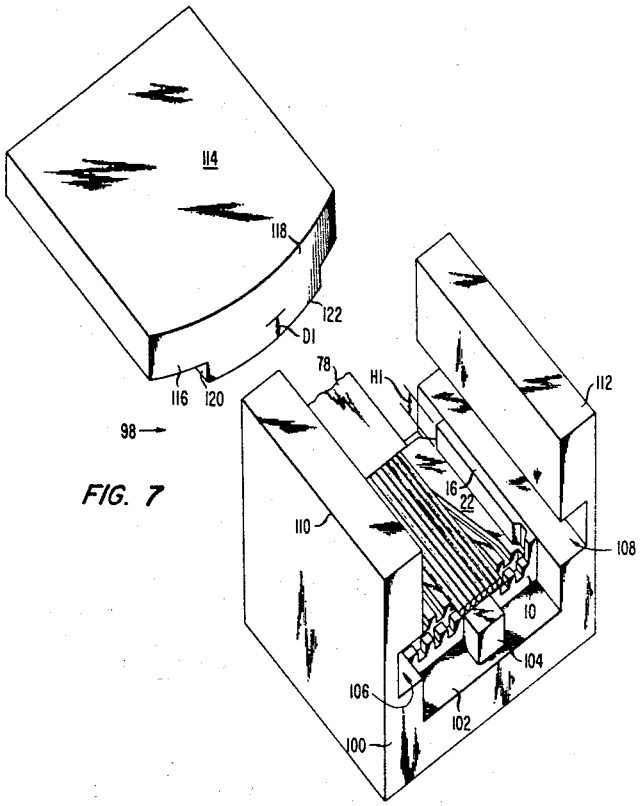
FIG. 7 is an exploded view of an assembly tool for use in practicing the invention, the preassembly of FIG. 5 being seated in the base of the tool.

In practicing the invention otherwise than by use of the assembly tool of FIG. 7, one may apply any suitable line contact surface to the preassembly of FIGS. 5 and 6, e.g., surface 138 of cover 56 (FIG. 4). Thus, surface 138 may be applied to surface 22 of the FIG. 5 preassembly and advanced thereacross in the manner of platen 120 surface 122 in one or more strokes to effect the forced lodging of conductors in channels 24–38. The line contact surface may be arcuate as in the case of surface 122, rectilinear as in the case of surface 138, tapered transversely, peaked centrally, etc., as the user or specific given pattern may require.

While the invention has been shown by the foregoing, various changes may evidently be introduced therein without departing from the invention. Thus, the particularly described preferred embodiments and practices are intended in an illustrative and not in a limiting sense. The true spirit and scope of the invention are set forth in the following claims.

I claim:

1. Apparatus for assembling the conductors of a flat multiconductor cable to a connector body having opposed upper and lower surfaces defining a body height and having a plurality of spaced conductor retention channels extending into said body through said upper surface, said apparatus comprising:

a base having a floor surface for receipt thereon of said lower surface of said connector body;

a pair of upstanding, spaced sidewalls on said base and extending therefrom;

a movable ram having a conductor engaging surface thereon movably supported by said upstanding sidewalls in a manner such that said conductor engaging surface traverses a path substantially parallel to said floor surface, said ram being supported such that during the course of movement, a spacing is defined between said conductor engaging surface and said floor surface that is not greater than the body height of said body connector; and means for holding a connector body in a fixed position relative to said base during the course of movement of said ram, whereby a connector body placed on said floor surface with conductors of a flat multiconductor cable disposed initially over the upper surface of said connector body may have such conductors forcedly assembled into said connector body channels by the movement of said conductor engaging surface of said movable ram, the conductor engagement surface being in an interference relation with the upper surface of said connector body during the course of movement of said ram.

2. An apparatus according to claim 1, further including a stop member supported by said base adjacent said base floor surface.

3. An apparatus according to claim 2, wherein said stop member is disposed between said spaced sidewalls and projects upwardly from said base floor surface.

4. A tool for assembling the conductors of a flat multiconductor cable to a connector body having opposed upper and lower surfaces and a plurality of spaced conductor retention channels extending into said body through said upper surface, said tool comprising:

a base having a floor surface for receipt thereon of said lower surface of said connector body;

a ram supported by said base for sliding movement relative thereto, said ram having a conductor engaging surface that during the course of ram sliding movement traverses a path in spaced disposition relative to said base floor surface, a stop member disposed on said base adjacent said floor surface, said stop member for engaging a connector body placed on said base floor surface and retaining such connector body in a fixed position relative to said base during the course of sliding movement of said ram, whereby conductors placed initially over the upper surface of said connector body may be forcedly assembled into said connector body channels by the conductor engaging surface of said sliding ram.

5. A tool according to claim 4, wherein said base and said ram define cooperative track and tongue means for slidably supporting said ram relative to said base.

6. A tool according to claim 5, wherein said base includes a pair of upstanding, spaced sidewalls, said ram being slidably supported by such sidewalls.

7. A tool according to claim 6, wherein each of said sidewalls has a recessed track therein spaced upwardly from said base floor surface and wherein said ram has a pair of opposed side tongues slidably received respectively in said sidewall tracks.

8. A tool according to claim 7, wherein said sidewall tracks extend fully along the sidewalls from one end to a second end thereof, whereby the sliding ram may be received at such one end of said base and exited at said second end.

9. A tool according to claim 8, wherein said stop member projects upwardly from said base floor surface, an upper surface of said stop member being spaced downwardly below said tracks of said sidwealls such that said sliding ram may pass thereover during the course of movement.

10. A tool according to claim 4, wherein said connector body defines between its upper and lower surfaces a body height and wherein said conductor engaging surface on said ram traverses a path substantially parallel to said base floor surface, the conductor engaging surface being spaced from said floor surface during sliding movement of said ram a distance not greater than the connector body height.

* * * * *